US005257448A

United States Patent [19]

Pearce et al.

[11] Patent Number: 5,257,448

[45] Date of Patent: Nov. 2, 1993

[54] CLOTHES DRYER WITH UNITARY BULKHEAD

[75] Inventors: Thomas M. Pearce, Green Lake; Timothy K. Studt; Arlynn H. Sanders, both of Ripon, all of Wis.

[73] Assignee: Speed Queen Company, Ripon, Wis.

[21] Appl. No.: 810,589

[22] Filed: Dec. 19, 1991

[51] Int. Cl.[5] ..... B23P 11/00; F26B 11/02

[52] U.S. Cl. ..... 29/434; 29/897; 34/133 F

[58] Field of Search ..... 29/897.3, 897, 434; 34/133 F, 133 G, 133 H; 72/379.2

[56] References Cited

U.S. PATENT DOCUMENTS

| | | | |
|---|---|---|---|
| 1,942,353 | 1/1934 | Berger | 72/379.2 X |
| 2,626,454 | 1/1953 | Richardson | 72/379.2 X |
| 2,641,826 | 6/1953 | Dreznes | 29/897 X |
| 3,216,691 | 11/1965 | Fradin | 29/897.3 X |
| 3,816,942 | 6/1974 | Smith | 34/133 F X |
| 4,535,502 | 8/1985 | Grass | 29/897.3 X |
| 4,754,556 | 7/1988 | Carr | 34/133 H |
| 4,817,297 | 4/1989 | Toma et al. | 34/133 F |

*Primary Examiner*—Joseph M. Gorski

*Attorney, Agent, or Firm*—William R. Clark; Richard M. Sharkansky

[57] ABSTRACT

A bulkhead for a tumbler clothes dryer wherein the bulkhead panel is stamped as a unitary part from a single metal blank on a progressive die. The bulkhead panel includes a cylindrical plug portion which fits inside the tumbler drum, and four mounting brackets each extending from a respective one of the four quadrants of the plug portion. Each mounting bracket includes a face portion, a leg portion, and a foot mounting portion. Drum bearings are connected to the bulkhead panel to form the bulkhead. The rear bulkhead mounts to the back panel of the cabinet, and the front bulkhead mounts to the front edges of the two cabinet side panels.

12 Claims, 4 Drawing Sheets

CLOTHES DRYER WITH UNITARY BULKHEAD

BACKGROUND OF THE INVENTION

The field of the invention generally relates to tumbler clothes dryers, and more particularly relates to clothes dryer bulkheads and a method of manufacturing such bulkheads.

As is well known in the art, tumbler clothes dryers typically have a horizontally disposed tumbler cylinder or drum that is rotated by a belt drive to tumble the clothes inside the drum. In the normal arrangement, the ends of the drum are covered by stationary panels commonly referred to as bulkheads which serve a number of functions. First, the bulkheads serve to retain the clothes within the drum. Second, the bulkheads provide a substantially air tight seal so that hot air can be drawn through the drum. Third, the drum is supported by bearings which are mounted to the bulkheads.

Prior art bulkheads are typically constructed by stamping a metal blank to form a disc or panel that has a raised cylindrical plug portion which is sized to be surrounded by a sealing gasket and then inserted into an end of the drum. Mounting brackets are mounted to peripheral side portions of the disc by a fastening technique such as welding, and a pair of suitable drum support bearings such as rollers or glide pads are attached to lower peripheral regions of the disc. In fabrication, the rear bulkhead is attached to the back panel of the dryer cabinet by inserting screws through the mounting brackets which have stand-off legs to provide a heater box space between the bulkhead and the cabinet back panel. After the drum is properly supported on the rollers and positioned around the gasket of the rear bulkhead plug portion, the plug portion of the front bulkhead is inserted into the front end of the drum, and then the mounting brackets of the front bulkhead are screwed to the front edges of the side panels of the dryer cabinet.

In one typical prior art arrangement, the pair of drums support bearings (e.g. rollers or glide members) are mounted to the disc at respective locations approximately 45° and 30° up from the bottom with the higher mounting location being in the direction of rotation of the drum. The mounting brackets, which are relatively small and have relatively small vertical span to reduce complexity, size, and cost, are attached to respective mid-level portions of the disc at approximately 90° up from bottom with screws that are only slightly above and below the 90° positions.

There are serious drawbacks with the above described bulkhead assembly and method of manufacture. First, with the mounting brackets being welded to the disc or panel, there is the cost of labor involved in the welding process, as well as the cost for additional parts. Further, the welding process increases the dimensional tolerances of the bulkhead assembly thereby sometimes making it difficult to mount the bulkhead to the cabinet panel. For example, the bulkhead or the cabinet panel may have to be flexed or bowed to align the corresponding screw holes, and this dimensional instability detracts from the rigidity of the dryer. Also, because the mounting brackets are made relatively small to minimize cost, the assembly is relatively weak and is susceptible to bending, flexing, or vibrating. Further, there are relatively large moment arms between the rollers or glide pads that support the drum and the mounting locations of the mounting brackets. Thus, the disc may have a tendency to deflect or vibrate.

SUMMARY OF THE INVENTION

It is an object of the present invention to provide an improved bulkhead for use with a tumbler clothes dryer.

It is an also object to provide a bulkhead and method of manufacturing the same that reduces the parts, materials, and labor.

It is a further object to provide a bulkhead that is more rigid and has improved dimensional stability to reduce bending, oil canning, and/or vibration.

Another object is to provide a bulkhead that effectively and efficiently absorbs and transmits the rotational forces of the drum to the dryer's cabinet.

It is a further object to provide a bulkhead that minimizes the moment arms between the drum supporting bearings and the mounting brackets to the cabinet panel.

It is a further object to provide a bulkhead that includes surface area for readily and conveniently mounting clothes dryer components.

In accordance with the invention, a method of fabricating a bulkhead for a clothes dryer having a tumbler drum comprises the step of forming a bulkhead panel from a single metal blank wherein the bulkhead panel comprises a circular plug portion adapted for insertion into the drum and a mounting bracket extending from each quadrant of the plug portion. The method may also include the step of attaching drum bearings to the bulkhead panel. It is preferable that the method further include the step of attaching a sealing gasket around the circular plug portion before insertion into the drum. Further, the forming step may preferably comprise a plurality of stamping steps on a progressive die. Each of the mounting brackets may comprise a face portion joined to the circular plug portion, a leg portion joined to a respective one of the face portions and extending substantially perpendicular thereto, and a foot mounting portion joined to the leg portion and extending substantially parallel with the circular plug portion. Each of the drum bearings may comprise a roller attached to a respective one of the face portions. Alternately, each drum bearing may comprise a glide pad.

The invention may also be practiced by a method of fabricating a clothes dryer comprising the steps of forming a tumbler drum, stamping from respective single metal blanks front and rear bulkhead panels each comprising a circular plug portion and a mounting bracket joined to and extending from each of the four quadrants of the plug portion. Each of the mounting brackets comprises a face portion joined to and extending substantially parallel to the circular plug portion, a leg portion joined to a respective one of the face portions and extending substantially orthogonal thereto, and a foot mounting portion connected to a respective one of the leg portions and extending substantially parallel to the plug portion. The method further comprises connecting tumbler drum bearings to lower ones of the face panels on each of the rear and front bulkhead panels, forming a cabinet having a back panel and parallel opposing side panels, and then mounting the rear bulkhead panel to the back panel of the cabinet by connecting the foot mounting portion of each of the mounting brackets to the cabinet back panel. The method further comprises the steps of positioning the tumbler drum around the plug portion of the rear bulkhead panel with the tumbler drum being supported on the drum bearings of the rear bulkhead panel, inserting the plug portion of the front bulkhead panel into the front end of the tumbler drum with the tumbler drum resting on the drum bearings of the front bulkhead panel, and attaching the foot mounting portions of the mounting brackets of the front bulkhead panel to the side panels of the cabinet.

In accordance with another aspect of the invention, a bulkhead for a clothes dryer having a tumbler drum comprises a bulkhead panel formed from a single metal blank, such panel comprising a circular plug portion adapted for insertion into the drum and a mounting bracket extending from each quadrant of the plug portion, and drum bearings attached to the bulkhead panel.

With such arrangement, the mounting brackets are formed as part of the stamping process so the prior art step of attaching the mounting brackets by welding is eliminated. Further, the size of a substantially rectangular metal blank is optimized by forming the mounting brackets from corner regions of the blank such that one mounting bracket is formed in each quadrant of the circular plug portion. One advantage of such arrangement is that there is dimensional stability or consistency between the mounting brackets so that they can be easily and readily aligned with corresponding mounting apertures in the back panel of the cabinet without bending or flexing either part. Also, the moment arms between the drum bearings and mounting brackets are reduced so that the force of the tumbler drum is better absorbed and transferred to the dryer cabinet than with prior art apparatus. Also, with the heretofore described arrangement with a mounting bracket in each quadrant of the plug portion, the bulkhead is more rigid and less likely to flex; therefore, there is less fatigue stress. Further, mounting brackets provide a convenient surface for mounting dryer components such as an electrical terminal block.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 2:
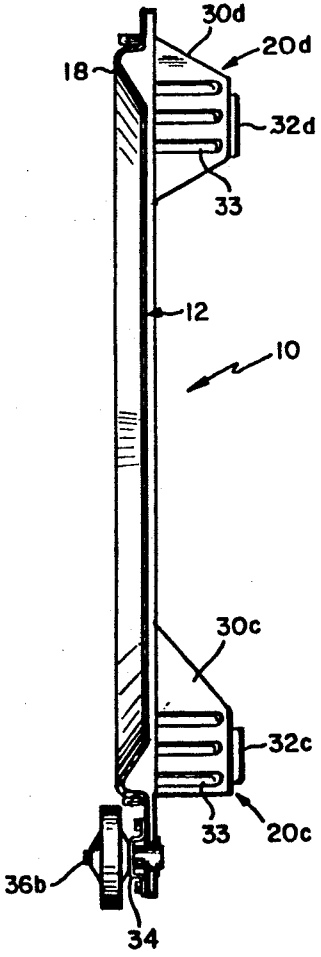
FIG. 2 is a sectioned view taken along line 2—2 of FIG. 1.
Figure 1:
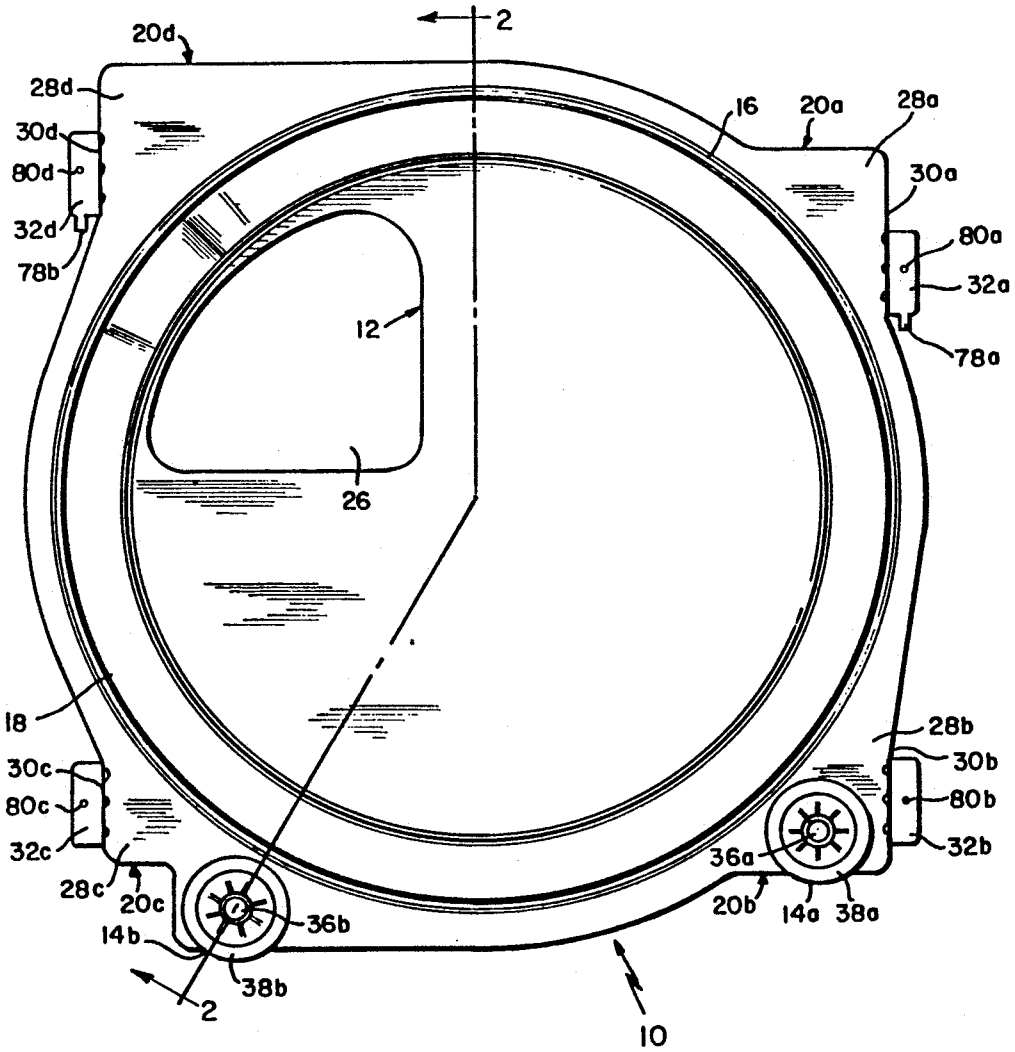
FIG. 1 is a front view of a rear bulkhead.
Figure 5:
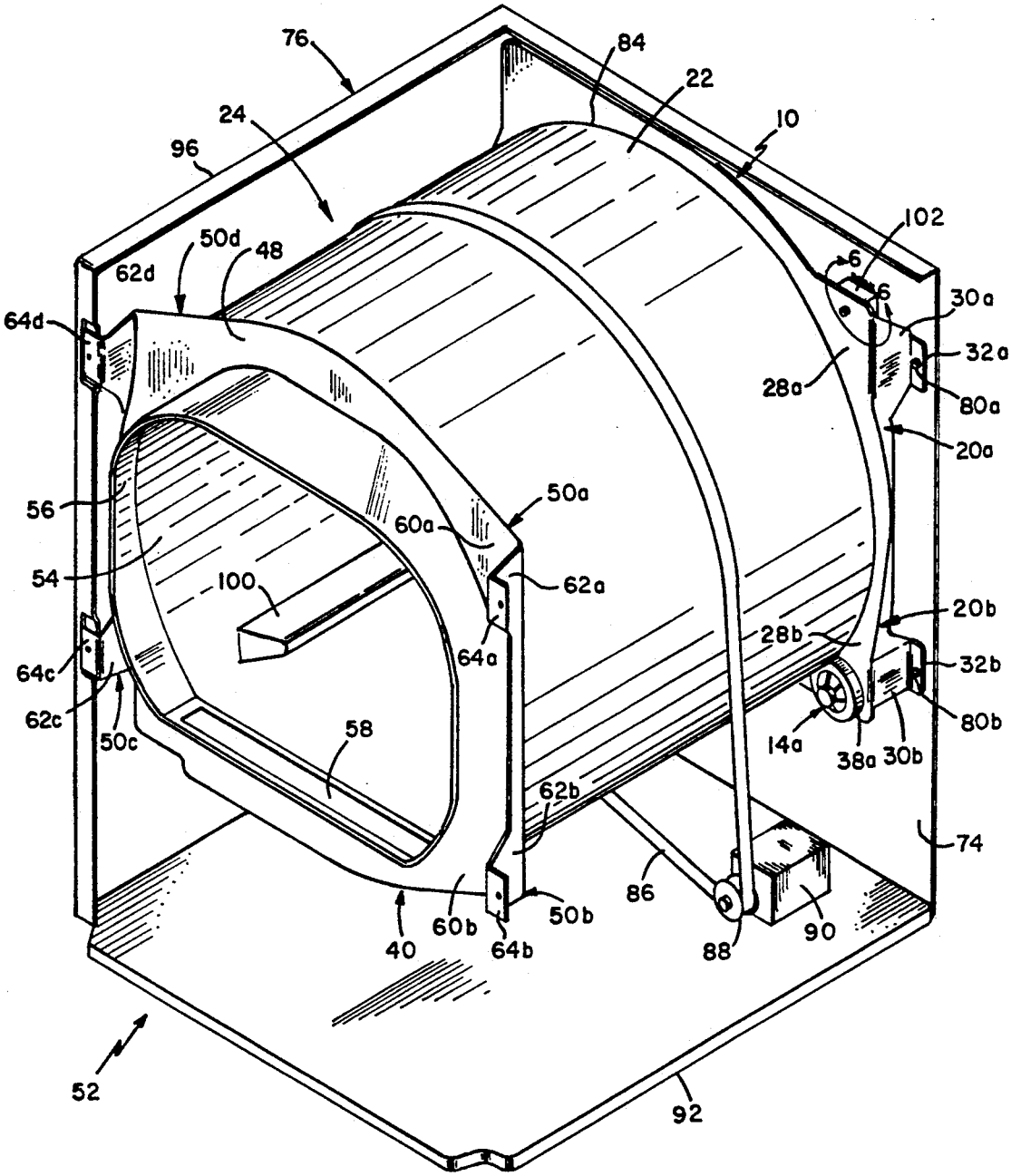
FIG. 5 is a front perspective view of a tumbler clothes dryer partially disassembled.

Referring to FIGS. 1 and 2, front and sectioned side views respectively show rear bulkhead 10 which includes bulkhead panel 12, drum bearings 14*a* and *b*, and sealing gasket 16. In accordance with the invention, bulkhead panel 12 is fabricated as a unitary part by stamp forming from a single metal blank. In particular, a progressive die is used, and the metal blank is sequenced along an eight station die run on a transfer press. Bulkhead panel 12 includes a cylindrical plug portion 18 and four mounting brackets 20*a*–20*d* which are connected to the cylindrical plug portion 18 and extend respectively from the four quadrants thereof. Each of the four mounting brackets 20*a–d* is disposed at an approximate mid-region of its respective quadrant. By such arrangement, the use of the metal blank is optimized thereby minimizing material; also, the four quadrant attachment of bulkhead panel 12 to back panel 74 (FIG. 5) makes bulkhead panel 12 stronger and more rigid. Cylindrical plug portion 18 is sized to insert in the rear end 22 of drum 24 (FIG. 5). As is conventional, cylindrical plug portion 18 has a heater input aperture 26 through which heated air is drawn into drum 24.

Each mounting bracket 20*a–d* has a face portion 28*a–d*, a leg portion 30*a–d*, and a foot mounting portion 32*a–d*. The face portions 28*a–d* extends substantially parallel from the cylindrical plug portion 18 in the lateral and up/down directions. The leg portions 30*a–d* connect to the respective face portions 28*a–d* and extend in the rearward direction to provide an offset space behind rear bulkhead 10 for the positioning of the heater element (not shown). The foot mounting portions 32*a–d* connect to the respective leg portions 30*a–d* and extend in the lateral directions substantially parallel to the face portions 28*a–d*.

As shown in FIG. 2, leg portions 32*a–d* here have formed ribs 33 or indentations to provide increased structural rigidity, and face portions 28*a–d* may also have such reinforcing structure.

After the stamping of bulkhead panel 12 as a unitary part on a progressive die from a single metal blank, bulkhead panel 12 is processed and painted in a conventional manner. Then, sealing gasket 16 is attached around the circumference of cylindrical plug portion 18, and tumbler or drum bearings 14*a* and *b* are attached to face portions 28*b* and *c* of the bottom two mounting brackets 20*b* and *c*. In particular, each drum bearing 14*a* and *b* here includes reenforcement housing 34, and a shaft 36*a* and *b* connected to a respective roller wheel 38*a* and *b*.

In an exemplary embodiment, cylindrical plug portion 12 has a diameter of approximately 24", leg portions 30*a–d* provide a standoff distance of approximately 2.5", respective screw holes 80*c* and *d* are vertically spaced by approximately 19", and respective screw holes 80*a* and *b* are vertically spaced by approximately 16". Further, roller wheel 38*a* is located 45° clockwise from bottom while roller wheel 38*b* is located 30° counter-clockwise from bottom. Such arrangement is optimized for counter-clockwise rotation of drum 24.

Figure 4:
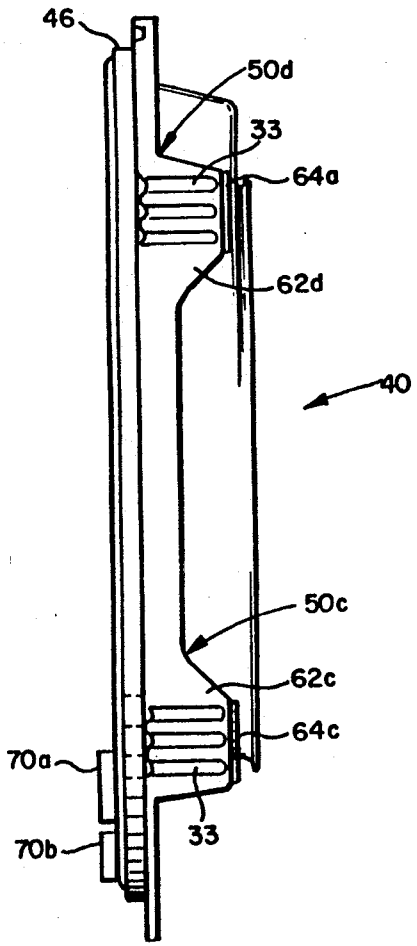
FIG. 4 is a side view of the bulkhead of FIG. 3.
Figure 3:
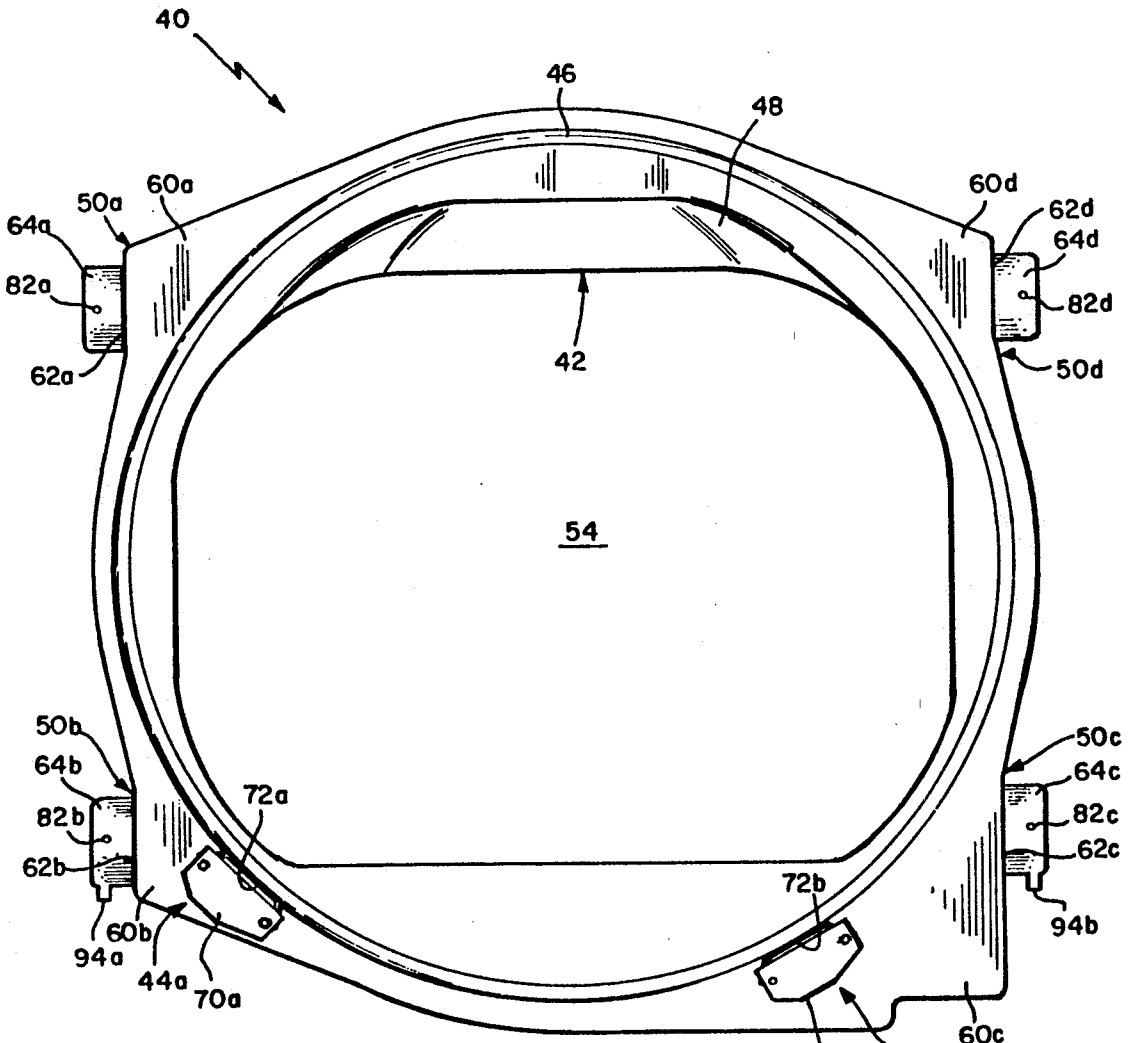
FIG. 3 is a rear view of a front bulkhead.

Referring to FIGS. 3 and 4, rear and side views show front bulkhead 40 to include a bulkhead panel 42, drum bearings 44*a* and *b* and sealing gasket 46. Like the rear bulkhead panel 12, the front bulkhead panel 42 is fabricated as a unitary part by a progressive die stamping process using a single metal blank. The front bulkhead panel 42 includes a cylindrical plug portion 48 and four mounting brackets 50*a–d*. As can be seen in FIG. 5, which shows a perspective view of dryer 52 with the front bulkhead 40 at the front, cylindrical plug portion 48 includes a large central access opening 54 which includes a tunnel portion 56 having lint filter aperture 58.

As with the rear bulkhead panel 12, each mounting bracket 50*a–d* of the front bulkhead panel 42 includes a face portion 60*a–d*, a leg portion 62*a–d*, and a foot mounting portion 64*a–d*. Each face portion 60*a–d* is connected to the cylindrical plug portion 48 and extends in the lateral and up/down directions substantially parallel to the cylindrical plug portion 48. The mounting brackets 50*a–d* are arranged at the approximate midpoints of the four respective quadrants so as to reduce the size of the required metal blank, and also to increase the rigidity after mounting to dryer cabinet 76 (FIG. 5). The leg portions 62*a–d* connect to the respective face portions 60*a–d* and extend in the forward direction. The foot mounting portions 64*a–d* connect to the respective leg portions 62*a–d* and extend in the lateral directions.

After the front bulkhead panel 42 is stamped as a unitary part from a single metal blank as described above, panel 42 is processed and painted or porcelainized in conventional manner. Then, sealing gasket 46 is attached around the circumference of cylindrical plug portion 48 and drum bearings 44*a* and *b* are attached to face portions 60*b* and *c* of the two bottom mounting brackets 50*b* and *c*. Roller wheels identical to roller wheels 38*a* and *b* of rear bulkhead 10 could be used for drum bearings 44*a* and *b*. Here, however, drum bearings 44*a* and *b* are glide assemblies and used as an alternate embodiment to optimize the cost of using roller wheels 38*a* and *b* for supporting drum 24 (FIG. 5) at the front. Each front drum bearing 44*a* and *b* includes a bracket 70*a* and *b* holding a respective glide pad 72*a* and *b* which preferably is fabricated of a low-friction wear-resistant material on which drum 24 rotates.

In an exemplary embodiment, screw holes 82*a* and *b* and 82*c* and *d* are vertically spaced approximately 15", respectively. Furthermore, screw holes may be horizontally spaced approximately 25". Thus, with mounting brackets 50*a–d* being somewhat uniformly spaced in the four respective quadrants of cylindrical plug portion 48, front bulkhead 40 like rear bulkhead 10, is a relatively rigid and secure structure when mounted to cabinet 76.

Referring to FIG. 5, there is shown a front perspective view of tumbler clothes dryer 52 with the front, top, and one side panel missing. Also missing are the controls and air flow apparatus which are conventional and not needed for an understanding of the present invention. In fabrication, the heater assembly (not shown) is screwed to the rear bulkhead 10, and then rear bulkhead 10 is mounted to the back panel 74 of the dryer cabinet 76. More specifically, locator tabs 78*a* and *b* extending from the bottom of foot mounting portions 32*a* and *d* as shown in FIG. 1 are inserted into corresponding slots (not shown) on back panel 74. Because bulkhead panel 12 including mounting brackets 20*a–d* is stamped, the spacing or relative location between locator tabs 78*a* and *b* is precisely fixed by the stamping die, and therefore the locator tabs 78*a* and *b* precisely align with the corresponding slots in back panel 74 which is also formed by stamping. In other words, if mounting brackets 20*a* and *d* were welded onto cylindrical plug portion 18 instead of being part of a unitary stamped part, the tolerance or dimensional spacing between locator tabs 78*a* and *b* could vary such that inserting locator tabs 78*a* and *b* into the corresponding slots could require bending or flexing either rear bulkhead 10 or back panel 74. Here, however, the dimensional tolerance is substantially eliminated and locator tabs 78*a* and *b* readily and easily slip into slots thereby supporting rear bulkhead 10 on back panel 74. Similarly, screw holes 80*a–d* readily align with corresponding screw holes (not shown) in back panel 74, and rear bulkhead is securely attached to back panel 74.

The rear rim 84 of drum 24 is then disposed around central plug portion 18 with sealing gasket 16 providing a substantially air tight but rotatable seal therebetween. The rear of drum 24 is supported by roller wheels 38*a* and *b* which are disposed at an approximately 45° and 30°, respectively up from bottom.

Belt 86 is then positioned around drum 24 an connected to belt drive 88 which is coupled to motor 90 mounted on base 92.

Front bulkhead 40 is then positioned at the front of drum 24 with cylindrical plug portion 48 and sealing gasket 66 inserted into drum 24 to provide a substantially air tight but rotatable seal. Locator tabs 94*a* and *b* insert into corresponding slots in the front edge of side panels 96 of cabinet 76. Thus, front bulkhead 40 is held in position for the attachment of screws through screw holes 82*a–d* into the front edges of side panels 96. Air flow apparatus (not shown) is connected to the underside of lint filter aperture 58 to draw heated air from the heater assembly (not shown) through the heater input aperture 26 and longitudinally to the front of drum 24 and out lint filter aperture 58. As is conventional, a portion of the air may be recirculated through the heat assembly with another portion being exhausted. As the hot air is drawn through drum 24, belt 86 rotates drum 24 and the clothes are lifted by vanes 100 to be tumbled through the hot air.

Figure 6:
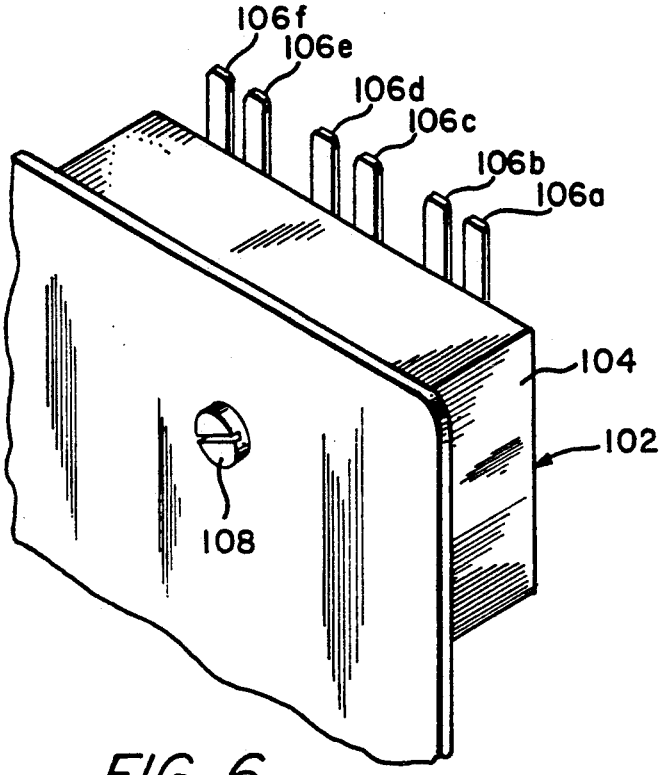
FIG. 6 is an expanded view of circle 6—6 of FIG. 5.

Referring to FIG. 6, an expanded view of circle 6—6 of FIG. 5 shows an electrical terminal block 102 mounted to the rear of face panel 28*a* of mounting bracket 20*a*. In particular, terminal block 102 here includes a dielectric housing 104 to which conductor strips 106*a–f* are attached and selectively interconnected to electrically connect attached wires (not shown) in conventional manner. The rear side of face portion 28*a* provides a convenient location for mounting terminal block 102 by inserting a screw 108 through the front of face portion 28*a*. The area is readily accessible for maintenance and repair, and avoids mounting such block 102 to the cabinet 76. As shown in FIG. 1, mounting bracket 20*a* and face portion 28*a* are slightly lower than corresponding mounting bracket 20*d* to provide more convenient access to terminal block 102.

In accordance with the invention, the stamping of rear and front bulkhead panels 12 and 42 as unitary parts from single metal blanks provides a number of advantages. First, the number of parts and the labor costs of assembling such parts is reduced. For example, the labor costs associated with the prior art method of welding mounting brackets 20*a–d* and 50*a–d* to respective cylindrical plug portions 18 and 48 are eliminated. Second, as described above, there is greater dimensional consistency or uniformity (i.e. less tolerance) between mounting brackets 20*a–d* and 50*a–d* because such dimensions are fixed by the stamping die rather than being dependent on a subsequent welding step that introduces variances. Thus, rear bulkhead panel 12 can easily and readily be mounted to back panel 74 without flexing either part to attain alignment of locator tabs 78*a* and *b* and screw holes 80*a–d* to corresponding apertures in back panel 74. As a result, there is improved rigidity of rear bulkhead 10. Third, by stamping bulkhead panels 12 and 42, mounting brackets 20*a–d* and 50*a–d* can be conveniently positioned at angular locations that are approximately centered in the four quadrants of respective cylindrical plug portions 18 and 48. More specifically, rather than welding a pair of mounting brackets at opposing mid-level regions (i.e. 90° and 180°) as was done in the prior art to keep the mounting brackets relatively small and simple, it is advantageous to use four mounting brackets 20*a–d* and 50*a–d* on each bulkhead 10 and 40, and to locate a mounting bracket in each quadrant (e.g., at approximately 45°, 135°, 225°, and 315°). With such arrangement, the size of the required metal blank is minimized. With each quadrant of bulkheads 10 and 40 being mounted to supporting structure i.e. back panel 74 and side panels 96, respectively), the bulkheads 10 and 40 are more rigid and less likely flex or bend at the top and bottom. Therefore, there is less fatigue stress. Also, with mounting brackets 20*a–d* and 50*a–d* located as described, the moment arms from drum bearings 14*a* and *b* and 44*a* and *b* to respective mounting brackets 20*a–d* and 50*a–d* are reduced. Thus, the mounting brackets 20*a–d* and 50*a–d* are better able to absorb and transmit the drum forces to the dryer cabinet 76; this also results in less fatigue stress on the front and rear bulkheads 10 and 40. Furthermore, the precise and fixed locations of mounting brackets 20*b* and *c* and 50*b* and *c* provides improved alignment for drum bearings 14*a* and *b* and 44*a* and *b*. Thus, there is less vibration and bouncing of drum 24 as it rotates. Finally, the heretofore described arrangement of mounting brackets 20*a–d* and 50*a–d* provides a convenient area for the mounting of electrical components.

The foregoing description of the preferred embodiment will bring to mind many modifications and alterations that do not depart from the spirit and scope of the invention. Accordingly, it is intended that the scope of the invention be limited only by the appended claims.

What is claimed is:

1. A method of fabricating a bulkhead for a tumbler clothes dryer having a tumbler drum, comprising the steps of:

forming from a single metal blank a bulkhead panel comprising a circular plug portion adapted for insertion into said drum and a mounting bracket extending from each quadrant of said plug portion wherein each of said mounting brackets comprises a face portion joined to said circular plug portion, a leg portion joined to said face portion and extending substantially perpendicular thereto, and a foot mounting portion joined to said leg portion and extending substantially perpendicular thereto; and attaching drum bearings to lower ones of said face portions of said mounting brackets.

2. The method recited in claim 1 further comprising the step of attaching a sealing gasket around said cylindrical plug portion.

3. The method recited in claim 1 wherein said forming step comprises a plurality of stamping steps on a progressive die.

4. The method recited in claim 1 wherein each of said drum bearings comprises a roller.

5. The method recited in claim 1 wherein each of said drum bearings comprises a glide pad.

6. The method recited in claim 1 wherein at least two of said foot mounting portions comprises locator tabs.

7. A method of fabricating a clothes dryer, comprising the steps of:

forming a tumbler drum;

stamping from respective single metal blanks front and rear bulkhead panels each comprising a circular plug portion and a mounting bracket joined to and extending from each of the four quadrants of said plug portion wherein each of said mounting brackets comprises:

a) a face portion joined to and extending substantially parallel to said circular plug portion;

b) a leg portion joined to said face portion and extending substantially orthogonal thereto; and c) a foot mounting portion connected to said leg portion and extending substantially parallel to said plug portion;

connecting tumbler drum bearings to lower ones of said face portions on each of said rear and front bulkhead panels;

forming a cabinet having a back panel and parallel opposing side panels;

mounting said rear bulkhead panel to the back panel of said cabinet by connecting the foot mounting portion of each of said mounting brackets to said cabinet back panel;

positioning said tumbler drum around said plug portion of said rear bulkhead panel with said tumbler drum being supported on the drum bearings of said rear bulkhead panel;

inserting said plug portion of said front bulkhead panel into the front end of said tumbler drum with said tumbler drum resting on the drum bearings of said front bulkhead panel; and attaching the foot mounting portions of said mounting brackets of said front bulkhead panel to said side panels of said cabinet.

8. The method recited in claim 7 further comprising the step of positioning a sealing gasket around each of said circular plug portions of said front and rear bulkheads before insertion into said tumbler drum.

9. The method recited in claim 7 wherein said stamp forming step comprises a plurality of stamping steps on a progressive die.

10. The method recited in claim 7 wherein said drum bearings of said rear bulkhead comprise rollers.

11. The method recited in claim 7 wherein said drum bearings of said front bulkhead comprises glide pads.

12. The method recited in claim 7 wherein each of said foot mounting portions of said rear bulkhead panel comprises a locator tab and said back panel of said cabinet comprises corresponding slots, said mounting step comprising the steps of inserting said locator tabs in said respective slots and then attaching said foot mounting portions to said back panel using screws.

* * * * *